US009554421B2

(12) United States Patent
Meusburger

(10) Patent No.: US 9,554,421 B2
(45) Date of Patent: Jan. 24, 2017

(54) OVEN APPLIANCE HAVING RESISTIVE TOUCHSCREEN AND METHOD FOR OPERATING SAME

(71) Applicant: General Electric Company, Schenectady, NY (US)

(72) Inventor: Eric Xavier Meusburger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 260 days.

(21) Appl. No.: 14/224,151

(22) Filed: Mar. 25, 2014

(65) Prior Publication Data

US 2015/0282251 A1 Oct. 1, 2015

(51) Int. Cl.

| | |
|---|---|
| ***H05B 1/02*** | (2006.01) |
| ***F24C 3/12*** | (2006.01) |
| ***H05B 6/06*** | (2006.01) |
| ***F24C 7/08*** | (2006.01) |

(52) U.S. Cl.

CPC ..... *H05B 1/0263* (2013.01); *F24C 3/124* (2013.01); *F24C 7/086* (2013.01); *H05B 1/0266* (2013.01); *H05B 6/062* (2013.01)

(58) Field of Classification Search

CPC ..... H05B 1/0263; H05B 1/0266; H05B 6/062; H05B 1/02; F24C 3/124

USPC ..... 219/494, 497, 506, 412–414, 483, 486

See application file for complete search history.

(56) References Cited

U.S. PATENT DOCUMENTS

| | | | | |
|---|---|---|---|---|
| 3,632,985 | A * | 1/1972 | Bare | G05D 23/22 219/499 |
| 4,369,352 | A * | 1/1983 | Bowles | F24C 14/02 219/395 |
| 7,461,588 | B2 * | 12/2008 | Head | F24C 7/082 219/412 |
| 8,345,022 | B2 * | 1/2013 | Shen | G06F 3/0418 178/18.02 |
| 2003/0117476 | A1 * | 6/2003 | Cross | G06F 3/045 347/107 |
| 2003/0127451 | A1 * | 7/2003 | Lile | A47J 27/62 219/497 |
| 2010/0253637 | A1 * | 10/2010 | Lieberman | G06F 3/0421 345/173 |
| 2011/0314401 | A1 * | 12/2011 | Salisbury | H04N 5/232 715/771 |

FOREIGN PATENT DOCUMENTS

| | | |
|---|---|---|
| JP | 2013-054520 | 3/2013 |
| KR | 20040064291 | 7/2004 |
| WO | WO 03/49002 | 6/2003 |

* cited by examiner

*Primary Examiner* — Mark Paschall
(74) *Attorney, Agent, or Firm* — Dority & Manning, P.A.

(57) ABSTRACT

Oven appliances and methods for operating oven appliances are provided. An oven appliance includes a cooking assembly, the cooking assembly including a heating element. The oven appliance further includes a user interface panel, the user interface panel comprising a resistive touchscreen operable to transmit electrical signals. The oven appliance further includes a controller in communication with the resistive touchscreen and the heating element. The controller is operable to receive the electrical signals, select a calibration set based on a temperature-related operating condition, and interpret the electrical signals based on the selected calibration set.

12 Claims, 4 Drawing Sheets

OVEN APPLIANCE HAVING RESISTIVE TOUCHSCREEN AND METHOD FOR OPERATING SAME

FIELD OF THE INVENTION

The present disclosure relates generally to oven appliances and methods for oven appliance operation. In particular, the present disclosure is directed to the use of resistive touchscreens in oven appliances, and methods which utilize such resistive touch technology.

BACKGROUND OF THE INVENTION

Oven appliances are frequently utilized in a variety of settings to cook food items. During operation of an oven appliance, relatively high temperatures can be generated, for example, in the cooking chamber or on the cooktop of the oven appliance. These high temperatures can affect the ambient temperatures surrounding the various electronic controls of the oven appliance. For example, when the oven appliance is operating in a cooking mode, such temperatures can range from 50 degrees Celsius ("° C.") to 85° C. Further, during a self-clean cycle, the heating elements in the cooking chamber can generate heat such that ambient temperatures of the various electronic controls can reach extremely high levels, such as up to 105° C.

Many modern oven appliances include a user interface panel that allows a user to interact with the oven appliance to, for example, turn the appliance on, adjust temperatures of the appliance, set built-in timers, etc. Further, touchscreens for use with user interface panels have recently increased in popularity.

The current approach to developing touchscreens for oven appliances has been to avoid the use of resistive touch screens. Resistive touchscreens are susceptible to changes in resistivity measurements due to temperature fluctuations, thus leading to inaccuracies in the touchscreen feedback and communication. The wide range of temperatures that oven appliances experience has thus previously made resistive touchscreens undesirable for use with oven appliances.

Accordingly, many currently known oven appliances utilize capacitive touchscreens. Capacitive touchscreens are not as susceptible to inaccuracies due to temperature fluctuations, and have thus been considered better suited for oven appliance applications. However, capacitive touchscreen technology is relatively expensive, leading to such touchscreen technology only being utilized in higher end oven appliance models.

Accordingly, improved oven appliances and methods for operating oven appliance are desired. In particular, oven appliance and methods which utilize affordable and accurate touchscreen technology would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an oven appliance is provided. The oven appliance includes a cooking assembly, the cooking assembly including a heating element. The oven appliance further includes a user interface panel, the user interface panel comprising a resistive touchscreen operable to transmit electrical signals. The oven appliance further includes a controller in communication with the resistive touchscreen and the heating element. The controller is operable to receive the electrical signals, select a calibration set based on a temperature-related operating condition, and interpret the electrical signals based on the selected calibration set.

In accordance with another embodiment, a method for operating an oven appliance is provided. The method includes receiving electrical signals from a resistive touchscreen, selecting a calibration set based on a temperature-related operating condition, and interpreting the electrical signals based on the selected calibration set.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
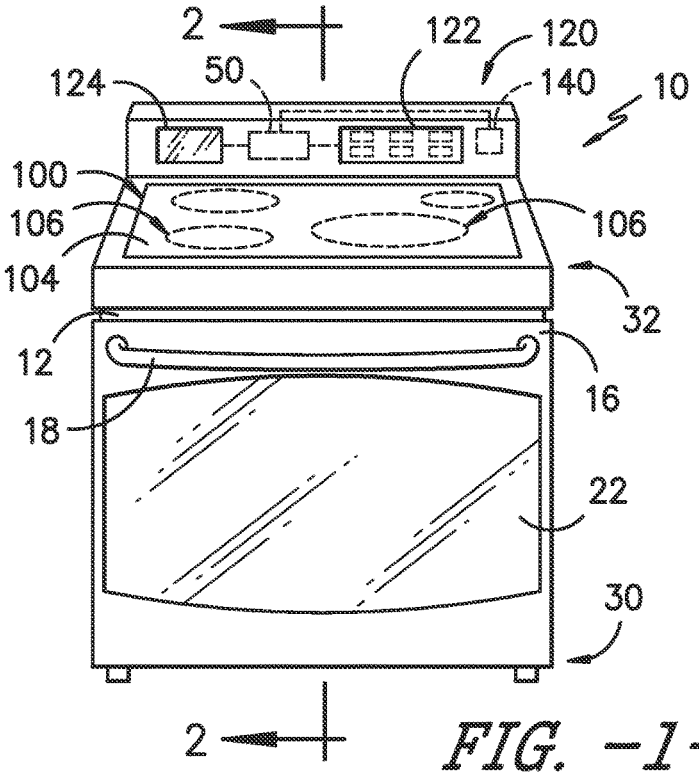
FIG. 1 provides a perspective view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
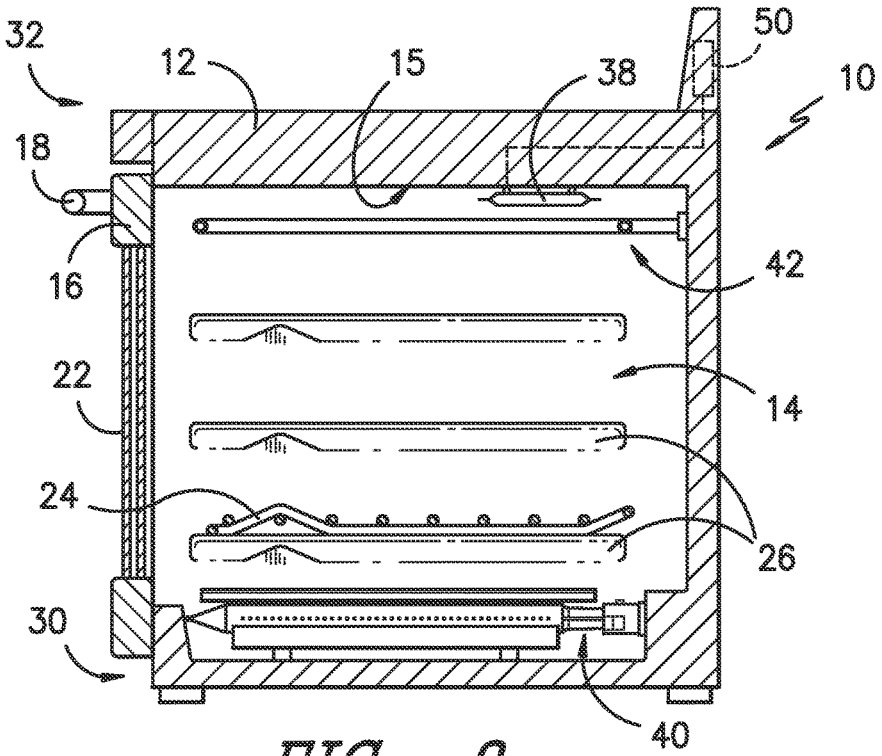
FIG. 2 provides a section view of the oven appliance of FIG. 1 taken along the 2-2 line of FIG. 1.

FIG. 1 provides a perspective view of an oven appliance 10 according to an exemplary embodiment of the present subject matter. FIG. 2 provides a section view of oven appliance 10 taken along the 2-2 line of FIG. 1. Oven appliance 10 is provided by way of example only and is not intended to limit the present subject matter in any aspect. Thus, the present subject matter may be used with other oven appliance configurations, e.g., that define one or more interior cavities for the receipt of food and/or having different pan or rack arrangements than what is shown in FIG. 2. Further, the present subject matter may be used in any other suitable appliance.

Oven appliance 10 generally includes a cooking assembly. The cooking assembly may include one or more heating elements. For example, in some embodiments, the cooking assembly, and thus the oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14.

Oven appliance 10 can include a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open.

A gas fueled or electric bottom heating element 40 (e.g., a gas burner or a bake gas burner) is positioned in cabinet 12, e.g., at a bottom portion 30 of cabinet 12. Bottom heating element 40 is used to heat cooking chamber 14 for both cooking and cleaning of oven appliance 10. The size and heat output of bottom heating element 40 can be selected based on the e.g., the size of oven appliance 10.

A top heating element 42 is also positioned in cooking chamber 14 of cabinet 12, e.g., at a top portion 32 of cabinet 12. Top heating element 42 is used to heat cooking chamber 14 for both cooking/broiling and cleaning of oven appliance 10. Like bottom heating element 40, the size and heat output of top heating element 42 can be selected based on the e.g., the size of oven appliance 10. In the exemplary embodiment shown in FIG. 2, top heating element 42 is shown as an electric resistance heating element. However, in alternative embodiments, a gas, microwave, halogen, or any other suitable heating element may be used instead of electric resistance heating element 42.

The operation of oven appliance 10 including heating elements 40 and 42 is controlled by a processing device such as a controller 50, which may include a microprocessor or other device that is in communication with such components. Such controller 50 may also be communication with a temperature sensor 38 that is used to measure temperature inside cooking chamber 14 and provide such measurements to the controller 50. Temperature sensor 38 is shown (in FIG. 2) in the top and rear of cooking chamber 14. However, other locations may be used and, if desired, multiple temperature sensors may be applied as well.

Figure 3:
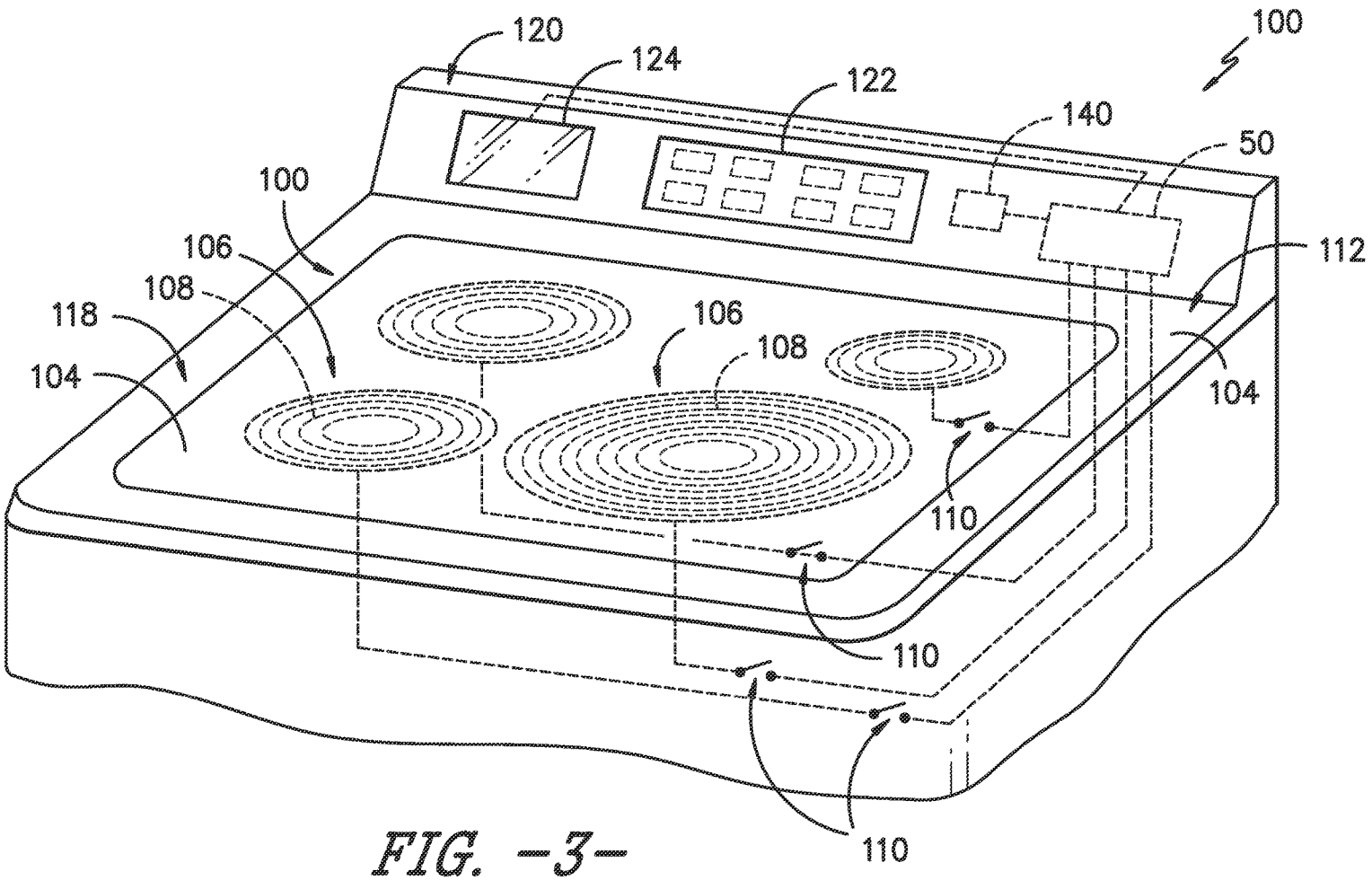
FIG. 3 provides a perspective view of an exemplary embodiment of an oven appliance cooktop according to an exemplary embodiment of the present subject matter.

Referring now to FIG. 3, the cooking assembly, and thus the oven appliance 10 may additionally or alternatively include a cooktop 100. Cooktop 100 may be disposed on the cabinet 12. As show, cooktop 100 may include a top panel 104. By way of example, top panel 104 may be constructed of glass, ceramics, enameled steel, and combinations thereof. Heating assemblies 106, which in this embodiment are electric heating assemblies but in alternative embodiments may be gas burners or induction assemblies, may be mounted, for example, below the top panel 104. While shown with four heating assemblies 106 in the exemplary embodiment of FIG. 3 (as well as FIG. 1), cooktop appliance 100 may include any number of heating assemblies 106 in alternative exemplary embodiments. Heating assemblies 106 can also have various diameters. For example, each heating assembly of heating assemblies 106 can have a different diameter, the same diameter, or any suitable combination thereof. Each heating assembly may include one or more heating elements 108. Further, a relay 110 may be coupled to each heating element 108. Relays 110 can selectively activate the associated heating elements 108 as desired. Activation of a heating element 108 can cause electricity to be flowed to that heating element 108, which in turn can cause the heating element 108 to generate heat. This heat may be transferred through the top panel 104 to utensils positioned on the top panel 104. The operation of heating elements 108, such as through operation of relays 110, may be controlled by a processing device such as controller 50.

Referring to FIGS. 1 through 3, oven appliance 10 may further include a user interface panel 120, which may as shown be located within convenient reach of a user of the oven appliance 10. User interface panel 120 is generally a component that allows a user to interact with the oven appliance 10 to, for example, turn various heating elements (such as heating elements 40, 42, 108) on and off, adjust the temperature of the heating elements, set built-in timers, etc. A user interface panel 120 may include a touchscreen 122 and a graphical display 124, which may be separate from or a part of the touchscreen 122. The touchscreen 122, as discussed herein, may be utilized by a user to interact with the oven appliance 10 by touching the touchscreen 122 directly with, for example, a finger. Various commands for a user to select through such touching may be displayed by touchscreen 122, and detection of the user selecting a specific command by touching a distinct location on the touchscreen 122 may be detected by the controller 50, which is in communication with the touchscreen 122, based on electrical signals from the touchscreen 122. Graphical display 124 may generally deliver certain information to the user, which may be based on user selections and interaction with the touchscreen 122, such as whether a particular heating element is activated and/or the level at which the heating element is set.

Notably, controller 50 may be in communication with the touchscreen 122, graphical display 124, and one or more heating elements. Accordingly, input signals received from the touchscreen 122 may be provided to and interpreted by the controller 50, and the controller 50 may output corresponding control signals to the heating elements to operate the heating elements as desired.

Controller 50 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 50 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. User interface panel 120 and other components of oven appliance 10 may be in communication with controller 50 via one or more signal lines or shared communication busses.

Figure 4:
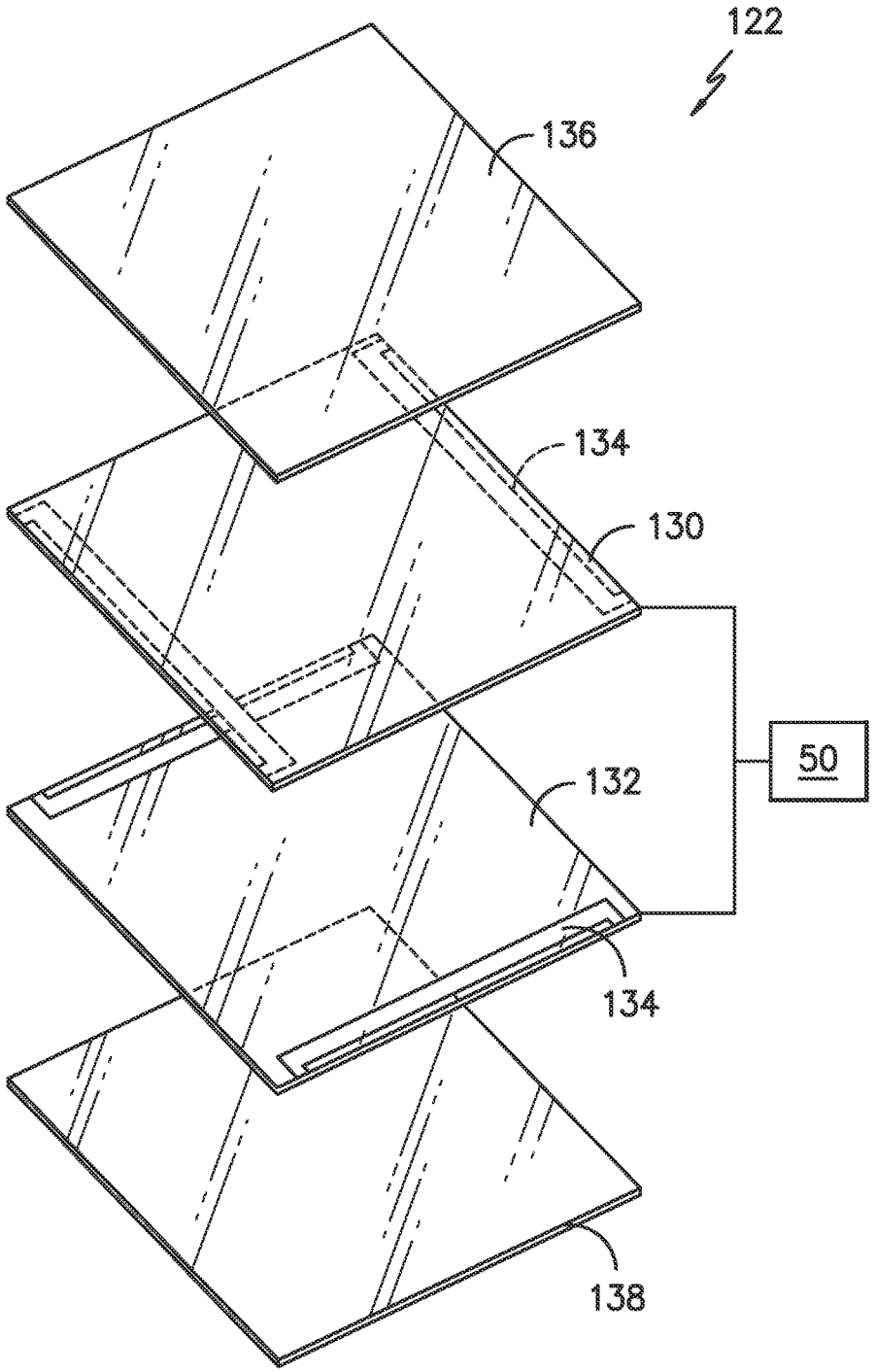
FIG. 4 provides an exploded perspective view of a resistive touchscreen in communication with a controller in accordance with one embodiment of the present disclosure.

Referring now to FIG. 4, touchscreen 122 is in exemplary embodiments a resistive touchscreen. The resistive touchscreen generally uses electrical resistance to determine the location on the touchscreen that a user has touched. Electrical signals based on this resistance and location thereof may be transmitted to the controller 50. The controller 50 may then receive electrical signals from the touchscreen 122 based on such touching and resistance, and may interpret the signals to determine a corresponding selected command by the user, and may transmit control signals to, for example, the required heating element(s) or other components as desired.

For example, as illustrated, a resistive touchscreen 122 may include a first panel 130 and a second panel 132 spaced apart from the first panel 130 by, for example, an air gap or suitable spacers. Each panel 130, 132 may be transparent and coated with a suitable conductive coating, such as an indium tin oxide coating. Conductive bars 134, for example, may be provided on each panel 130, 132. Touchscreen 122 may additionally, for example, include front and/or back flexible layers 136, 138, which may generally insulate and protect the panels 130, 132. The touchscreen 122 may be connected to the controller 50 as illustrated. As is generally understood, the location of contact on the touchscreen is determined by alternately applying power to the panels 130, 132 and obtaining, for example, a voltage value that corresponds to a location along an axis from the other respective panel 132, 130. This electrical signal can be transmitted to the controller 50. The controller 50 can receive electrical signal(s) from the resistive touchscreen 122 and interpret the electrical signals to output, for example, a digital value corresponding to the location of contact on the touchscreen 122. The controller 50 can additionally transmit control signals to, for example, one or more heating elements based on the location of contact on the touchscreen 122 and the corresponding intended command by the user.

As discussed herein, resistive touchscreens 122 are generally susceptible to inaccuracies due to temperature fluctuations. Accordingly, the present disclosure is further advantageously directed to novel methods and apparatus for calibrating resistive touchscreens, such that the touchscreens provide improved accuracy during operation with oven appliances 10. As discussed herein, calibration sets which correspond to various temperature-related operating conditions are selected and utilized to interpret the electrical signals form the touchscreen 122. Advantageously, the calibration sets include calibration data, such as adjustment factors, etc., for use in transfer functions or other suitable equations utilized to interpret the electrical signals. Accordingly, the resistive touchscreens 122 may be utilized with oven appliances 10 at a wide variety of temperatures, with the appropriate calibration set being utilized such that the accuracy of the touchscreen is maintained at such wide variety of temperatures.

Figure 5:
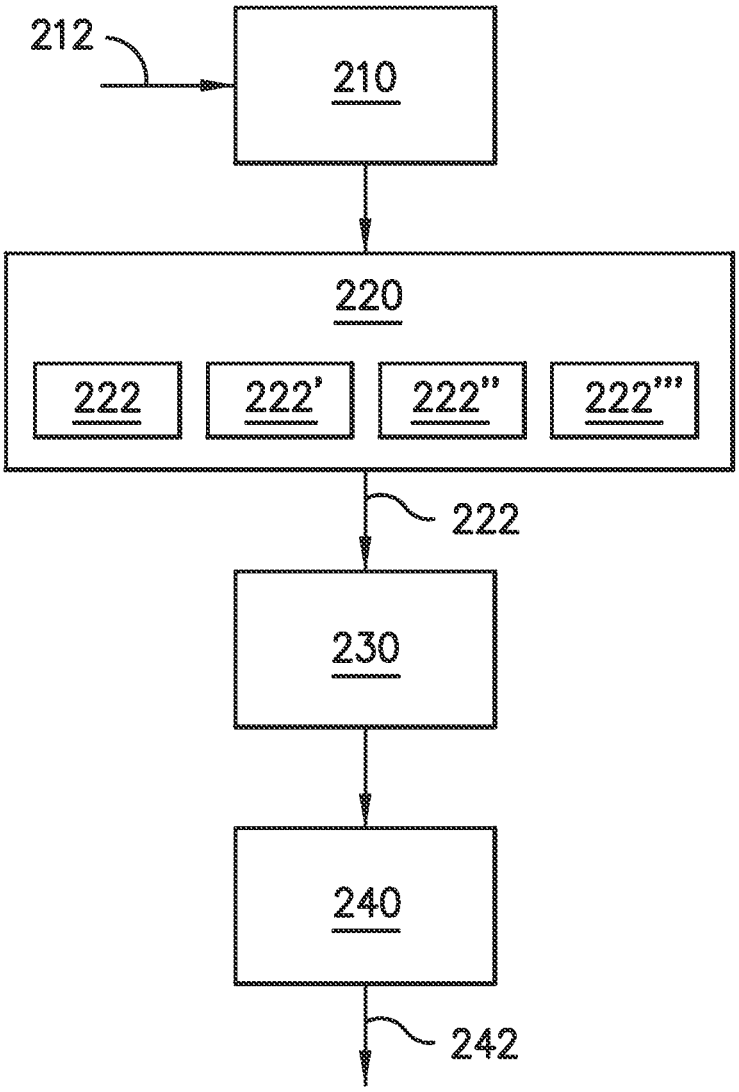
FIG. 5 provides a flowchart of a method for operating an oven appliance according to an exemplary embodiment of the present subject matter.

In particular, and referring to FIG. 5, calibration sets 222, 222', 222", 222'" have been developed based on temperature-related operating conditions for the oven appliance 10. The controller 50 may advantageously select a desired calibration set, such as set 222 as illustrated in FIG. 5, from a plurality of available calibration sets, based on the current, real-time level of the temperature-related operating condition. The controller 50 may then utilize this selected calibration set to interpret electrical signals 212 received from the resistive touchscreen 122, using for example a suitable transfer function.

A temperature-related operating condition is a condition of the oven appliance 10 that influences or is related to a temperature of the oven appliance 10. The controller 50 may receive electrical signals from a suitable component of the oven appliance 10 which communicate the temperature-related operating condition. Such communications may in exemplary embodiments advantageously be performed in real time. For example, in some embodiments, the operating condition may be a local temperature. Referring briefly to FIGS. 1 and 3, for example, a temperature sensor 140 is shown positioned proximate the touchscreen 122, such as within the user interface panel 120. Temperature sensor 140 may alternatively be within the user interface panel 120 and distal from the touchscreen 122, or in any other suitable location within oven appliance 10. The temperature sensor 140 may be in communication with the controller 50. A local temperature may be measured by this sensor 140, or alternatively by the temperature sensor 38 or any other suitable temperature sensor.

In other embodiments, the operating condition may be an operating mode of the oven appliance. Various operating modes may include, for example, standby, bake or broil or cooktop operation, broil and cooktop or self-clean operation, and self-clean and cooktop operation. It should be understood that the present disclosure is not limited to such operating modes. Notably, the temperature within or surrounding the oven appliance 10 may generally vary by operating mode, such that the operating mode is a temperature-related operating condition.

In still other embodiments, the operating condition may be an input power level. For example, the input power to one or more heating elements may be gas. A fuel line may provide fluid communication between a heating element, such as a burner, and a fuel source. A switch may activate a spark module to light the fuel being supplied to the heating element and/or allow fuel to flow to the heating element, such that the heating element is activated. The switch(es) may be in communication with the controller 50, which may operate the switches as required based on user input to the touchscreen 122. Accordingly, the amount of power generated during operation due to the flow of gas to one or more heating elements may be the operating condition. Additionally or alternatively, the input power to one or more heating elements may be electrical power. As illustrated in FIG. 3, for example, one or more heating elements 108 may be connected to an electrical power source, and may be in communication with the controller 50, such as through relays 110. The relays 110 may be in communication with the controller 50, which may operate the relays 110 as required based on user input to the touchscreen 122. Accordingly, the amount of power generated during operation due to the flow of electricity to one or more heating elements may be the operating condition.

The calibration set 222 that is utilized by the controller 50 to interpret the electrical signals may be selected from a plurality of available calibration sets 222, 222', 222", 222'". Two, three, four, five, six, seven, eight or more calibration sets 222 may be utilized and available for selection. Further, in exemplary embodiments, each calibration set 222, 222', 222", 222'" may correspond to a distinct level for the temperature-related operating condition. For example, in embodiments wherein the temperature-related operating condition is a local temperature, each calibration set may correspond to a distinct temperature level or range. In one non-limiting example, calibration set 222 may be utilized for a local temperature of approximately 25° C. or less, calibration set 222' may be utilized for a local temperature of greater than approximately 25° C. and less than or equal to approximately 60° C., calibration set 222" may be utilized for a local temperature of greater than approximately 60° C. and less than or equal to approximately 90° C., and calibration set 222''' may be utilized for a local temperature of greater than approximately 90° C. In embodiments wherein the temperature-related operating condition is an operating mode, each calibration set may correspond to a distinct mode. In one non-limiting example, calibration set 222 may be utilized for standby, calibration set 222' may be utilized for bake or broil or cooktop operation, calibration set 222" may be utilized for broil and cooktop or self-clean operation, and calibration set 222''' may be utilized for self-clean and cooktop operation.

In embodiments wherein the temperature-related operating condition is an input power level, each calibration set may correspond to a distinct gas or electric power level or range. In one non-limiting example, calibration set 222 may be utilized for an input power level of 0 British thermal units ("BTU"), calibration set 222' may be utilized for an input power level of greater than 0 BTU and less than or equal to approximately 16,000 BTU for the cooking chamber 14 heating elements and greater than 0 BTU and less than or equal to approximately 20,000 BTU for the cooktop 100 heating elements, calibration set 222" may be utilized for an input power level of greater than 0 BTU and less than or equal to approximately 16,000 BTU for the cooking chamber 14 heating elements and greater than 20,000 BTU and less than or equal to approximately 30,000 BTU for the cooktop 100 heating elements, and calibration set 222''' may be utilized for an input power level of greater than 0 BTU and less than or equal to approximately 16,000 BTU for the cooking chamber 14 heating elements and greater than 30,000 BTU and less than or equal to approximately 40,000 BTU for the cooktop 100 heating elements. In another non-limiting example, calibration set 222 may be utilized for an input power level of 0 Watts ("W"), calibration set 222' may be utilized for an input power level of greater than 0 W and less than or equal to approximately 4000 W for the cooking chamber 14 heating elements and greater than 0 W and less than or equal to approximately 4,000 W for the cooktop 100 heating elements, calibration set 222" may be utilized for an input power level of greater than 0 W and less than or equal to approximately 4,000 W for the cooking chamber 14 heating elements and greater than 4,000 W and less than or equal to approximately 6,000 W for the cooktop 100 heating elements, and calibration set 222''' may be utilized for an input power level of greater than 0 W and less than or equal to approximately 4,000 W for the cooking chamber 14 heating elements and greater than 6,000 W and less than or equal to approximately 8,000 W for the cooktop 100 heating elements.

Accordingly, the controller 50 may select a calibration set 222, 222', 222", 222''' that corresponds with the current, real time level of a temperature-related operating condition. This calibration set may be utilized to interpret the electrical signals 212 generated by the resistive touchscreen 122 by, for example, being utilized in a suitable transfer function wherein the electrical signals 212 are input and a digital value is output. The selected calibration set may thus calibrate the controller 50 response to the input electrical signals 212, such that the controller 50 interprets the electrical signals 212 based on the selected calibration set.

Referring again to FIG. 5, the present disclosure is further directed to methods for operating oven appliances 10. The various steps of methods disclosed herein may, for example, be performed by a controller 50 as discussed herein. A method may include, for example, the step 210 of receiving electrical signals 212 from a resistive touchscreen 122, as discussed herein. The method may further include, for example, the step 220 of selecting a calibration set 222, 222', 222", 222''' (222 is illustrated as the selected calibration set for illustrative purposes only) based on a temperature-related operating condition, as discussed herein. The method may further include, for example, the step 230 of interpreting the electrical signals 212 based on the selected calibration set 222, as discussed herein. Still further, in some embodiments, a method may additionally include, for example, the step 240 of transmitting a control signal 242 to a heating element based on the interpreted electrical signals 212, as discussed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cooking assembly, the cooking assembly comprising a heating element;

a user interface panel, the user interface panel comprising a resistive touchscreen operable to transmit electrical signals;

a temperature sensor positioned within the user interface panel; and a controller in communication with the resistive touchscreen and the heating element, the controller operable to receive the electrical signals, select a calibration set based on a temperature-related operating condition, and interpret the electrical signals from the resistive touchscreen based on the selected calibration set, wherein the temperature-related operating condition is a local temperature measured by the temperature sensor.

2. The oven appliance of claim 1, wherein the calibration set is selected from a plurality of available calibration sets.

3. The oven appliance of claim 2, wherein each of the plurality of available calibration sets corresponds to a distinct operating mode of the oven appliance or a distinct range of values for the input power level.

4. The oven appliance of claim 1, wherein the resistive touchscreen comprises a first panel and a second panel spaced apart from the first panel, the first panel and the second panel each coated with an indium tin oxide coating.

5. The oven appliance of claim 1, wherein the cooking assembly comprises a cabinet defining a cooking chamber, the cooking chamber configured for receipt of items to be cooked, and wherein the heating element is positioned within the cooking chamber.

6. The oven appliance of claim 1, wherein the cooking assembly comprises a cooktop, and wherein the heating element is a cooktop burner.

7. A method for operating an oven appliance, the method comprising:

receiving electrical signals from a resistive touchscreen of a user interface panel;

selecting a calibration set based on a temperature-related operating condition; and interpreting the electrical signals based on the selected calibration set, wherein the temperature-related operating condition is a local temperature measured by a temperature sensor positioned within the user interface panel.

8. The method of claim 7, wherein the calibration set is selected from a plurality of available calibration sets.

9. The method of claim 7, wherein the resistive touchscreen comprises a first panel and a second panel spaced apart from the first panel, the first panel and the second panel each coated with an indium tin oxide coating.

10. The method of claim 7, further comprising transmitting a control signal to a heating element based on the interpreted electrical signals.

11. The method of claim 10, wherein the heating element is positioned within a cooking chamber.

12. The method of claim 10, wherein the heating element is a cooktop burner.

* * * * *